United States Patent [19]

White

[11] Patent Number: 4,793,425

[45] Date of Patent: Dec. 27, 1988

[54] PROFILED BODY ROLLER-REAMER STABILIZER

[76] Inventor: Kenneth M. White, 2432 Paliswood Road, SW., Calgary, Alberta, Canada

[21] Appl. No.: 125,717

[22] Filed: Nov. 25, 1987

Related U.S. Application Data

[63] Continuation of Ser. No. 878,652, Jun. 26, 1986, abandoned.

[30] Foreign Application Priority Data

Jun. 26, 1985 [CA] Canada ..... 485295

[51] Int. Cl.[4] ..... E21B 10/30

[52] U.S. Cl. ..... 175/325; 175/346; 175/348

[58] Field of Search ..... 175/325, 344–348, 175/406, 408; 166/241

[56] References Cited

U.S. PATENT DOCUMENTS

| | | | |
|---|---|---|---|
| Re. 27,781 | 10/1973 | Garrett | 175/339 |
| 1,474,633 | 11/1923 | Hughes | 175/345 |
| 1,906,427 | 5/1933 | Sievers et al. | 175/346 |
| 2,122,763 | 7/1938 | Smith, Jr. | 175/346 |
| 2,154,553 | 4/1939 | Zublin . | |
| 2,742,264 | 4/1956 | Snyder . | |
| 3,220,497 | 11/1965 | Mori | 175/411 |
| 3,303,900 | 2/1967 | Kloesel, Jr. et al. | 175/339 |
| 3,306,379 | 2/1967 | Kloesel, Jr. et al. | 175/345 |
| 3,659,663 | 5/1972 | Dysart | 175/325 |
| 3,729,057 | 4/1973 | Werner | 175/262 |
| 3,754,609 | 8/1973 | Garrett | 175/323 |
| 3,820,613 | 6/1974 | White | 175/337 |
| 3,851,719 | 12/1974 | Thompson et al. | 175/406 |
| 3,907,048 | 9/1975 | Gray | 175/325 |
| 3,945,447 | 3/1976 | Peterson | 175/349 |
| 3,977,481 | 8/1976 | Fisk et al. | 175/228 |
| 3,978,933 | 9/1976 | Olson et al. | 175/325 |
| 4,013,325 | 3/1977 | Rear | 175/325 X |
| 4,020,910 | 5/1977 | Peterson et al. | 175/345 |
| 4,049,066 | 9/1977 | Richey | 175/323 |
| 4,189,012 | 2/1980 | Garrett | 175/312 |
| 4,220,213 | 9/1980 | Hamilton | 175/45 |
| 4,226,291 | 10/1980 | Spelts | 175/325 |
| 4,231,437 | 11/1980 | Swersky et al. | 175/325 |
| 4,245,708 | 1/1981 | Cholet et al. | 175/325 |
| 4,254,839 | 3/1981 | Schpok et al. | 175/372 |
| 4,262,759 | 4/1981 | Young et al. | 175/227 |
| 4,352,400 | 10/1982 | Grappendorf et al. | 175/330 |
| 4,385,669 | 5/1983 | Knutsen | 175/323 |
| 4,467,879 | 8/1984 | Burge | 175/325 |
| 4,548,284 | 10/1985 | Shinn et al. | 175/346 |

FOREIGN PATENT DOCUMENTS

| | | | |
|---|---|---|---|
| 84473 | 2/1976 | Australia | 175/325 |
| 888587 | 12/1971 | Canada . | |
| 898797 | 4/1972 | Canada . | |
| 959827 | 12/1974 | Canada . | |
| 960642 | 1/1975 | Canada . | |
| 1016534 | 8/1977 | Canada . | |
| 1024977 | 1/1978 | Canada . | |
| 1027549 | 3/1978 | Canada . | |
| 1044220 | 12/1978 | Canada . | |
| 1087165 | 10/1980 | Canada . | |
| 1093063 | 1/1981 | Canada . | |
| 1093064 | 1/1981 | Canada . | |
| 1110613 | 10/1981 | Canada . | |
| 1154430 | 9/1983 | Canada . | |
| 1174662 | 9/1984 | Canada . | |

*Primary Examiner*—Hoang C. Dang

*Attorney, Agent, or Firm*—Karen M. Gerken; James McGraw; Russel S. Smart

[57] ABSTRACT

A roller-reamer stabilizer having a plurality of roller cutters mounted in recesses in the supporting body such that each roller is free to rotate in its own bearing blocks. The cutters and bearing blocks are provided with air bleed lubrication and cooling from a central bore in the supporting body as is common and well known in the art. The present invention deals with the supporting body of a roller-reamer stabilizer of the near bit type and in particular one that would be used in the mining blast hole drilling industry. This supporting body is characterized by having a profiled lower end having maximum diameter outer surfaces separated by minimum diameter relief areas. The maximum diameter surfaces are, respectively, aligned with the cutters and extend upwardly from near the lower surface of the body to encompass the lower bearing blocks. The minimum diameter relief areas extend further up the body and terminate level with the upper bearing blocks. This configuration reduces the wear experienced in the vicinity of the lower bearing blocks.

8 Claims, 2 Drawing Sheets

PROFILED BODY ROLLER-REAMER STABILIZER

This application is a continuation of application Ser. No. 878,652, filed June 26, 1986, now abandonned.

This invention relates to a roller-reamer stabilizer used in rock drilling.

Open pit mining operations commonly remove overburden by a drill and blast routine. Several relatively shallow holes are drilled in a predetermined pattern depending on the fracture characteristics of the rock. These holes are charged with explosive and subsequently detonated such that the rock is fractured and can be removed with draglines or loaders. The drill and blast routine is repeated as required over the ore body in a manner such that as more overburden and ore is removed the characteristic step profile is generated with the distance between each level being approximately equal to the depth of the drilled blast holes.

A typical drilling configuration consists of a rock drill-bit, a roller-reamer stabilizer, a drill pipe and drilling machine.

Mining operations generally use compressed air for the removal of drill bit cuttings from the bore hole. This compressed air is supplied through a central bore in the drill pipe and roller-reamer stabilizer. Since the lifting capacity of compressed air is very limited, large volumes are required to remove cuttings of even a very small size. Over the years the volume of air as reflected by the annular velocity has increased from 900 meters per minute to 2000 meters per minute. This has led to substantial increases in compressor and drilling costs and in many operations even this air volume is inadequate to generate efficient bore hole cleaning.

Generally during blast hole drilling the first meter or more is badly fractured from the prior blast. As drilling progresses through this area pieces of rock are dislodged from the bore hole wall, these pieces are generally too large to be lifted by the compressed air and either fall to the hole bottom and are ground by the bit or they remain in suspension until the roller-cutters on the roller-reamer stabilizer grind them to a size that the air will lift and remove them from the bore hole. Since the number of blast holes required for a typical overburden removal sequence is large a considerable percentage of all blasthole drilling is done in this badly fractured area.

Prior art roller-reamer stabilizers indicate the occurrence of a very high percentage of large cuttings being ground and reground to a size by a characteristic known as belling of the lower portion of the stabilizer body and by accelerated wear of the lower portions of the roller cutters. Belling is caused by large cuttings being held in suspension due to the air flow not having sufficient lifting capacity to carry them to the roller cutters. These cuttings are continually forced against the bore hole wall and the relatively soft stabilizer body during the drilling operation and progressively wear away the stabilizer body. Accelerated wear of the lower portions of the roller cutters is caused naturally since the percentage of large cuttings reaching the roller cutters from the drill bit will always be greater than those falling back down the bore hole after the roller-reamer stabilizer has passed the critical fractured zone.

This invention overcomes the aforementioned problem of belling of the stabilizer body and accelerated wear of the lower portions of the roller cutters is reduced to a great extent. The means by which this is accomplished is relaively inexpensive and does not require any revisions to standard drilling practices or procedures.

According to a first broad aspect of the invention, there is provided a roller-reamer stabilizer body of generally tubular configuration, comprising means at one end of the body for sealing attachment to a rock drill bit and means at the other end of the body for attachment to a drill pipe, a plurality of elongate recesses spaced uniformly around the body and extending parallel to the longitudinal axis of the body, the recesses being dimensioned to receive respective cylindrical cutters, the tubular body being profiled over a portion starting from proximate the one end of the body and extending to the nearer ends of the recesses, the profiled portion having maximum diameter outer surfaces the maximum outer diameter of which is greater than the diameter of the remaining portion of the body which encompasses the remainder of the recesses.

According to a second broad aspect of the invention, there is provided a roller-reamer stabilizer comprising a generally tubular body, means at one end of the body for attachment to a rock drill bit and means at the other end of the body for attachment to a drill pipe, a plurality of elngate recesses spaced uniformly around the body and extending parallel to the longitudinal axis of the body, a plurality of cylindrical cutters received respectively partly in the recesses and rotatably mounted at both ends in bearing blocks carried by the body the, cutters having hard metal inserts on their peripheral surfaces for contact with a bore hole wall, the tubular body being profiled over a portion starting from proximate the one end of the body and just encompassing those bearing blocks which are nearer to the one end of the body, the profiled portion having maximum diameter outer surfaces the maximum outer diameter of which is greater than the diameter of the remaining portion of the body which encompasses the other bearing blocks.

In a preferred embodiment of the invention the profiled portion includes a plurality of longitudinally extending relief areas aligned respectively between each pair of cutters, the relief areas defining a minimum diameter which is less than the diameter of said remaining portion of the body. The relief areas preferably extend from proximate the one end of the body and beyond the nearer bearing blocks to terminate just before the further bearing blocks.

The invention will now be described in greater detail with reference to the accompanying drawings, in which.

Figure 1:
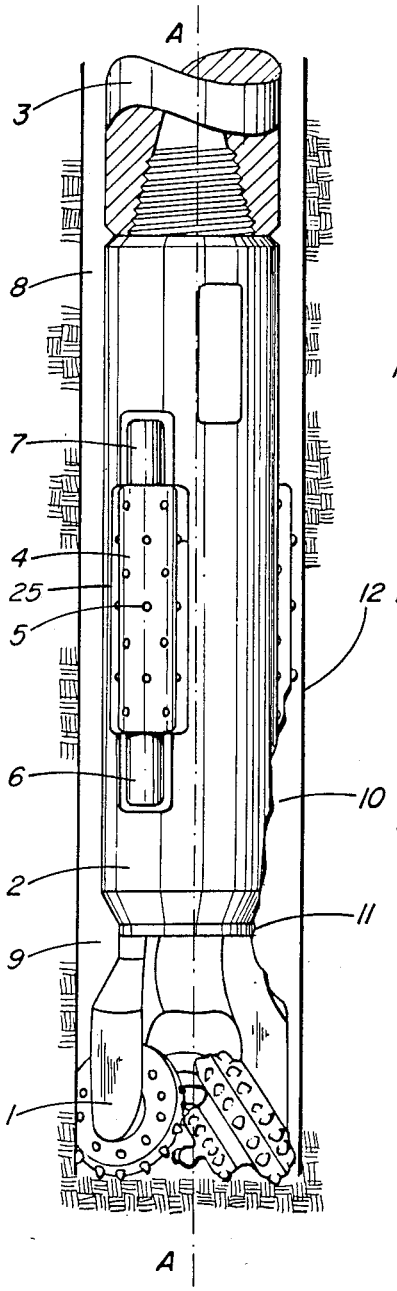
FIG. 1 PRIOR ART
FIG. 1 is an elevational view in partial longitudinal section, showing a prior art roller-reamer stabilizer as mounted and working in a drill string and indicating wear and general dimensional characteristics.

The roller-reamer stabilizer shown in FIG. 1 is as if split along line A—A with the new condition shown on the left and the worn condition shown on the right. With reference to the common details a rolling cutter rock bit 1 is attached by threaded means (not shown) to the lower end of the roller-reamer stabilizer body 2 which in turn is threaded at its upper end to the drill pipe 3. A typical roller-reamer cutter is shown at 4 and consists of a roller having hardmetal inserts 5 and two bearing blocks 6 and 7. Each cutter is received in a respective elongate recess 25 which is arranged parallel to the longitudinal axis of the body 2. Typically, there are three recesses spaced uniformly around the body. When received in its recess 25, the cutter surface projects above the periphery of the body 2. The annular clearance space 8 formed between the outside diameter of the roller-reamer body 2 and the bore wall is typically constant in prior art roller-reamer stabilizers in the new condition. During drilling the cuttings from the drill bit are lifted by compressed air and travel in the annular clearance space 8. Due to design limitations there is an increased clearance space 9 at the transition between rock bit 1 and roller-reamer body 2. Any cuttings larger than the annular clearance space 8 are held in suspension at this point by the compressed air or are wedged into the annular clearance space 8 between the roller-reamer body and the bore hole wall. This leads to accelerated wear of the roller-reamer body until the condition generally shown at 10 occurs.

Figure 2:
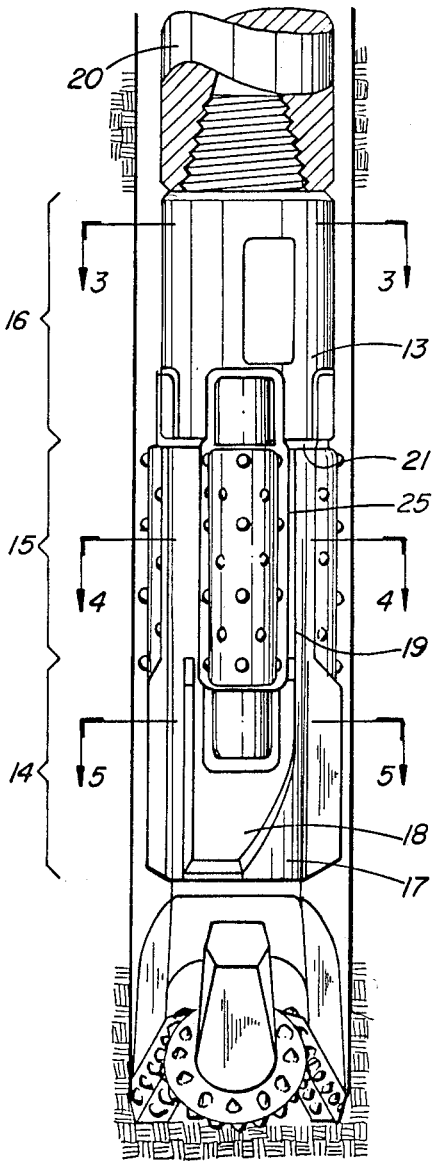
FIG. 2 is a view similar to FIG. 1 but illustrating a roller-reamer stabilizer according to the present invention.

The worn roller-reamer body in the location 10 tapers from the sealing face diameter 11 on rock bit 1 to the bore hole diameter at 12. The tapered portion of a roller-reamer cutter is usually 25% of the length of the roller. The excessive wear on the lower portion of the roller cutter indicates high forces have been encountered crushing the larger cuttings; further, this excessive wear on the lower bearing block 6 leads to exposure of the bearing pin or axle shaft of the roller-reamer cutter 4. Since compressed air is used to cool and lubricate the bearing surfaces any exposure of the axle shaft or bearing pin causes a loss of air that leads to early failure of the bearings in the rock bit. The roller-reamer stabilizer shown in FIG. 2 is according to the present invention. Roller-reamer body 13 is characterized by three defined zones 14, 15, 16. The profiled zone 14 has three minimum radius surfaces 17 approximately equal in diameter to the sealing face diameter 11, on FIG. 1 or 2, and three maximum radius surfaces 18 that are approximately 20 mm less in diameter than the rock bit extends from sealing face 11 to just beyond the lower bearing blocks 6, i.e. to just beyond the lower ends of the recesses 25. The roller zone 15 consists of three minimum radius surfaces that are a continuation of surfaces 17 of zone 14 three trailing ribs 19 that are substantially equal in diameter to the upper portion 16 and the drill pipe 20 and three transition surfaces 21 from surfaces 17 to the upper portion. Upper portion or zone 16 serves to adapt the roller-reamer body to various pipe sizes and is equal in diameter to the drill pipe 20 being used.

Figure 3:
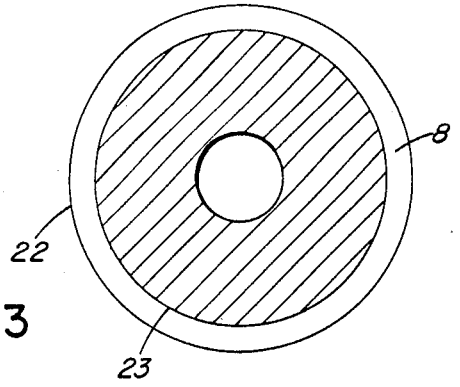
FIG. 3 is a sectional view along line 3—3 of FIG.2.

Dealing with the three individual zones in greater detail, FIG. 3 which illustrates zone 16 indicates the bore hole generally at 22 and body diameter 23 corresponding to pipe diameter 20 of FIG. 2. Annular clearance space 8 of FIG. 1 is provided for cutting removal. As a typical example in a 250 mm bore hole pipe diameter 23 would be 219 mm and the maximum cutting size would be 15.5 mm. This annular clearance is approximately twice the average cutting size under normal drilling conditions. However, when the bore hole is being drilled through the fractured zone from a previous blast debris is often dislodged from the bore hole wall that is larger than this clearance space.

Figure 4:
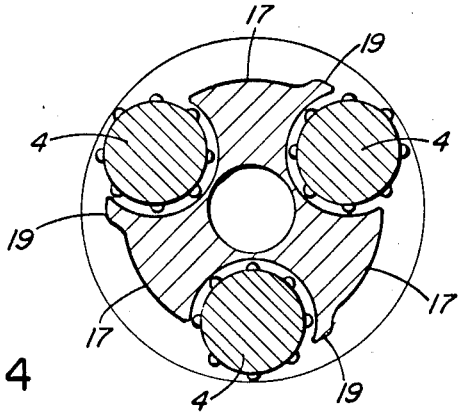
FIG. 4 is a sectional view along line 4—4 of FIG. 2.

FIG. 4 which illustrates zone 15 indicates the continuation of minimum radius surfaces 17 and trailing ribs 19. A typical diameter of surface 17 in a 250 mm bore hole is 190 mm. This will allow debris and cuttings up to 30 mm in size to pass. Surfaces 17 blend into the roller cutters on their leading edge at a constant radius such that any larger cuttings will be crushed between the bore hole wall and the hardmetal inserts on the rollers. Trailing ribs 19 reduce turbulence off the roller cutters and have a maximum diameter substantially equal to the body diameter 23 of zone 16. Transition surface 21 (FIG. 2) being at the upper terminus of zone 15 will retard any debris or cuttings larger than the annular clearance space from passing. Since the cuttings are in the roller zone they will be crushed. Providing a larger annular clearance space over the roller zone distributes the crushing load over the length of the roller and extends the roller life by reducing the concentrated loads that the lower end of the roller would take in prior art roller-reamer stabilizers.

Figure 5:
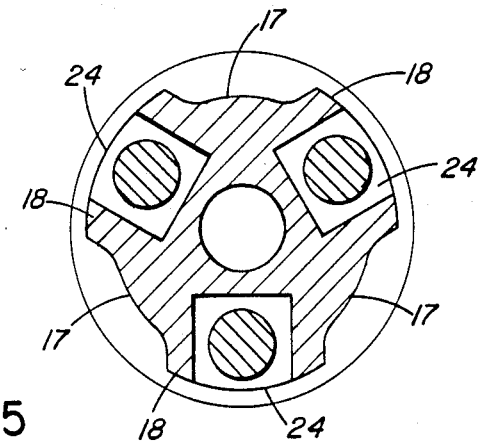
FIG. 5 is a sectional view along line 5—5 of FIG. 2.

FIG. 5 which illustrates zone 14 indicates the minumum radius surfaces 17 and maximum radius surfaces 18 as in section through the lower bearing blocks 24. The maximum radius surfaces 18 being larger in diameter than the drill pipe diameter 23 ensure that any cuttings fitting between the bore hole wall and surface 18 will pass freely through the annular clearance space 8 of FIG. 1. Furthermore, by increasing the surface diameter at 18 the annular velocity of the air flow is maintained or increased such that larger cuttings will be lifted to the roller cutters. Also with reference to FIG. 2 the trailing edge of maximum diameter surfaces 18 are profiles in such a manner that the orientation of the mounted rock bit is not critical relative to these surfaces.

The embodiments of the invention in which an exclusive property or privilege is claimed are defined as follows:

1. A roller-reamer stabilizer comprising a generally tubular body, means at a lower end of the body for sealing attachment to a rock drill bit and means at an upper end of the body for attachment to a drill pipe, a plurality of elongate recesses spaced uniformly around the body and extending parallel to the longitudinal axis of the body, a plurality of cylindrical cutters received partly in the respective recesses and rotatably mounted at upper and lower ends in upper and lower bearing blocks carried by the body, the tubular body having a profiled lower end portion defining circumferentially spaced maximum diameter outer surfaces spaced from one another by respective minimum diameter outer surfaces, the diameter of the tubular body being greatest at the maximum diameter outer surfaces and least at the minimum diameter outer surfaces, the maximum diameter outer surfaces being respectively aligned with the cutters, extending laterally as far as the longitudinal edges of the respective cutter, and extending upwardly from substantially adjacent the lower end of the body and terminating substantially adjacent the lower ends of the cutters, the minimum diameter outer surfaces extending upwardly from substantially adjacent the lower end of the body between respective pairs of recesses to a location upwardly of the lower ends of the cutters, said minimum diameter outer surfaces terminating substantially adjacent the upper ends of the cutters just before the upper bearing blocks, each minimum diameter outer surface extending laterally to an edge of at least one recess of the respective pair.

2. A roller-reamer stabilizer according to claim 1 in which a sealing face is provided at the lower end of the body and the diameter of the body at the minimum diameter outer surfaces is substantially equal to the diameter of the sealing face.

3. A roller-reamer stabilizer according to claim 1 wherein each minimum diameter outer surface extends laterally to an edge of only one recess of the respective pair, an upstanding trailing rib being provided along the edge of the other recess of the respective pair, the ribs forming extensions of the maximum diameter outer surfaces and the outer diameter of the ribs being substantially equal to that of the tubular body in the portion between the upper bearing blocks and the upper end of the body.

4. A roller-reamer stabilizer according to claim 1 in which there are three recesses and cutters.

5. A roller-reamer stabilizer body comprising a generally tubular body, means at a lower end of the body for sealing attachment to a rock drill bit and means at an upper end of the body for attachment to a drill pipe, a plurality of elongate recesses spaced uniformly around the body and extending parallel to the longitudinal axis of the body, the recesses being dimensioned to receive respective cylindrical cutters, the tubular body having a profiled lower end portion defining circumferentially spaced maximum diameter outer surfaces spaced from one another by respective minimum diameter outer surfaces, the diameter of the tubular body being greatest at the maximum diameter outer surfaces and least at the minimum diameter outer surfaces, the maximum diameter outer surfaces being respectively aligned with the recesses, extending laterally as far as the longitudinal edges of the respective recess and extending upwardly from substantially adjacent the lower end of the body and terminating substantially adjacent lower ends of the recesses, the minimum diameter outer surfaces extending upwardly from substantially adjacent the lower end of the body between respective pairs of recesses to a location upwardly of the lower ends of the recesses, said minimum diameter outer surfaces terminating substantially adjacent the upper ends of the recesses, each minimum diameter outer surface extending laterally to an edge of at least one recess of the respective pair.

6. A roller-reamer stabilizer body according to claim 5 in which a sealing face is provided at the lower end of the body and the diameter of the body at the minimum diameter outer surfaces is substantially equal to the diameter of the sealing face.

7. A roller-reamer stabilizer body according to claim 5 wherein each minimum diameter outer surface extends laterally to an edge of only one recess of the respective pair, an upstanding trailing rib being provided along the edge of the other recess of the respective pair, the ribs forming extensions of the maximum diameter outer surfaces, the outer diameter of the ribs being substantially equal to that of the tubular body in the portion between the upper ends of the recesses and the upper end of the body.

8. A roller-reamer stabilizer body according to claim 5 in which there are three recesses.

* * * * *